US006362563B1

(12) United States Patent
Chou et al.

(10) Patent No.: US 6,362,563 B1
(45) Date of Patent: Mar. 26, 2002

(54) TWO-LAYER CATHODE FOR ELECTRON GUN

(75) Inventors: Kuo-Ching Chou, Taipei; Shu-Hsien Lee, Taichung; Chin-Fu Tsai, Taoyuan, all of (TW)

(73) Assignee: Chunghwa Picture Tubes, Ltd., Yangmei Taoyuan (TW)

( * ) Notice: Subject to any disclaimer, the term of this patent is extended or adjusted under 35 U.S.C. 154(b) by 0 days.

(21) Appl. No.: 09/412,962

(22) Filed: Oct. 5, 1999

(51) Int. Cl.[7] ..... H01J 1/14
(52) U.S. Cl. ..... 313/346 R; 313/337
(58) Field of Search ..... 313/337, 346 R, 313/346 DC, 355; 252/521

(56) References Cited

U.S. PATENT DOCUMENTS 4,924,137 A * 5/1990 Watanabe et al. ..... 313/337
5,118,984 A * 6/1992 Saito et al. ..... 313/346 R

* cited by examiner

*Primary Examiner*—Vip Patel
*Assistant Examiner*—Ken A. Berck
(74) *Attorney, Agent, or Firm*—Emrich & Dithmar

(57) ABSTRACT

A cathode for use in an electron gun includes a base metal comprising Ni as a principal component and a two-layer electron emissive material disposed on the base metal. The inner layer is comprised of an alkaline earth metal oxide and 1–30 wt. % W and may further include 0.1–5 wt. % of a rare earth metal oxide. The outer layer is comprised of an alkaline earth metal oxide and may further include 0.1–5 wt. % of a rare earth metal oxide. The outer electron emissive layer provides stability for the cathode. In the degassing and activation process, W and Ni react at high temperatures to form a $Ni_4W$ fine crystal structure. An intermediate layer, such as $Ba_2SiO_4$, is dispersed in the $Ni_4W$ fine crystal structure in operation. Free barium is produced in reactions between the various cathode components to provide a high current density for the cathode. The normalized electron emission current value of the cathode does not decrease with use, even over extended periods of operation. While W has heretofore been used as a reducing agent in impregnating cathodes as well as in the base metal, it has not heretofore been used in an outer layer of a cathode.

10 Claims, 2 Drawing Sheets

TWO-LAYER CATHODE FOR ELECTRON GUN

FIELD OF THE INVENTION

The present invention relates generally to electron guns such as used in cathode ray tubes and is particularly directed to a cathode having improved emission characteristics for use in an electron gun.

BACKGROUND OF THE INVENTION

It is well known that the cathode plays an important role in the emission of electrons in an electron gun used in a cathode ray tube. The structure of a conventional cathode is shown in FIG. 1. A base metal 1 containing Ni as a principal component and a small amount of a reducing agent such as magnesium and silicon is connected to a cathode sleeve 3. A heating device 2 is used for heating an electron emissive layer 4 disposed on base metal 1.

A conventional oxide cathode is made by spraying a suspension on the base metal 1. The suspension is prepared by mixing alkaline earth metal carbonate by ball milling for 24 hours to get the desired particle size and viscosity. After the process of degassing, the coated suspension decomposes to an alkaline earth metal oxide. The reaction can be expressed as follow:

$$(Ba,Sr,Ca)CO_3 \rightarrow (Ba,Sr,Ca)O+CO_2 \quad (1)$$

The alkaline earth metal oxide will react with a reducing agent upon activation.

The reaction can be expressed as follows:

$$2BaO+Si \rightarrow 2Ba+SiO_2 \quad (2)$$

$$BaO+Mg \rightarrow Ba+MgO \quad (3)$$

The reducing agent in the base metal 1 diffuses outwardly at a much higher rate to react with the alkaline earth metal oxide to form an electron donor such as free barium. The free barium serves as a source of the electron beam at or in the vicinity of the boundary between the base metal 1 and the electron emissive layer 4.

As reactions (2) and (3) are carried out, another kind of product such as $SiO_2$ will react with the alkaline earth metal oxide continuously to produce an intermediate layer such as of $Ba_2SiO_4$. This intermediate layer decreases the outward diffusion rate of the reducing agent in the base metal 1. The rate of producing free barium is decreased and that results in not having enough free barium to produce saturated emission. Because of the limited amount of free barium in a conventional cathode, a conventional cathode can only be used at low current densities, e.g., 0.5–0.8 A/cm$^2$, and at low temperature, e.g., 700° C.–800° C.

U.S. Pat. No. 4,924,137 discloses an oxide-coated cathode for an electron gun comprising a base metal containing Ni as a major element; a reducing agent disposed in the base; a first electron-emissive layer containing (a) an alkaline earth metal oxide as a principal component containing at least Ba, and (b) a compound of Sc; a second electron-emissive layer formed on the first electron-emissive layer, containing (c) an alkaline earth metal oxide as a principal component also including at least Ba, and (d) at least one heat-resistive oxide selected from the group consisting of oxides of Al, Si, Ti, V, Cr, Fe, Zr, Nb, Hf, Ta, Mo, and W; and a heater for heating the electron-emissive layer. It is further taught that a small amount of metal powder may be added to the electron-emissive layer for improving the conductivity of this layer.

Mitsubishi Co. of Japan has developed a $Sc_2O_3$-dispersed oxide cathode with an enhanced current density of up to 2.0 A/cm$^2$. U.S. Pat. No. 5,122,707 discloses this approach wherein $Sc_2O_3$ reacts with an intermediate layer of $Ba_2SiO_4$ as follows:

$$Sc_2O_3+10Ni \rightarrow 2ScNi_5+3O \quad (4)$$

$$9Ba_2SiO_4+16ScNi_5 \rightarrow 4Ba_3Sc_4O_9+6Ba+9Si+80Ni \quad (5)$$

The decomposition reaction of $Ba_2SiO_4$ with $ScNi_5$ reduces the thickness of the intermediate layer so as not to hinder the reducing agent from diffusing outwardly to react as shown in reactions (2) and (3). A cathode produced in accordance with this approach includes sufficient free barium to produce high current densities.

Based on $Sc_2O_3$-dispersed technology, Mitsubishi Co. has further developed a W film-coated oxide cathode capable of producing current densities as high 3.6A/cm$^2$. U.S. Pat. No. 5,118,984 discloses the manufacturing process for this type of cathode. A base metal having a principal component of Ni and a small amount of a reducing agent such as magnesium and silicon is welded to the cathode sleeve. A metal film such as of W or Mo having a thickness less than 2 $\mu$m is applied to the base metal in $10^{-5}$–$10^{-8}$ torr by means of vacuum evaporation or sputtering. The cathode is then heated at 800° C.–1100° C. in an atmosphere of, for example, hydrogen to remove impurities such as oxygen remaining in the interior or on the surface of the metal layer, and to sinter or recrystallize the metal layer and diffuse the metal layer in the base metal. Finally, a layer of alkaline earth metal oxide comprising 0.01–9 wt. % $Sc_2O_3$ is sprayed on the cathode as the electron emissive material. The current density increases due to the W film sputtered on the base metal followed by thermal treatment to form a $Ni_4W$ fine crystal structure with the base metal during activation. The intermediate layer of $Ba_2SiO_4$ appears to be dispersed by the $Ni_4W$ fine crystal structure. This increases the diffusion path between the alkaline earth metal oxide and the reducing agent. The reactions (2) and (3) occur continuously to produce free barium to provide a high current density capability for the cathode.

SUMMARY OF THE INVENTION

An indirectly heated cathode according to an embodiment of this invention comprises an electron emissive substance with a two-layer structure. As in a conventional oxide cathode, a base metal has Ni as a principal component with a small amount of a reducing agent such as magnesium and silicon. A two-layer porous electron emissive substance is applied to the surface of the base metal. The outer electron emissive layer is comprised of an alkaline earth metal oxide which may include 0.1–5 wt. % of a rare earth metal oxide. The inner electron emissive layer is comprised of an alkaline earth metal oxide and 1–30 wt. % W and may also further include 0.1–5 wt. % of a rate earth metal oxide. The alkaline earth metal oxide contains barium oxide. The porous electron emissive substance is sprayed on a preheated metal base at the appropriate pressure. The emission current of the inventive cathode is not reduced after life testing of 3000 hours at current densities on the order of 2.0 A/cm$^2$, while the normalized emission current of a conventional oxide cathode typically decreases by approximately 30%, and the normalized emission current of a $Sc_2O_3$-dispersed type cathode typically decreases by approximately 14%.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE EMBODIMENT

Figure 1:
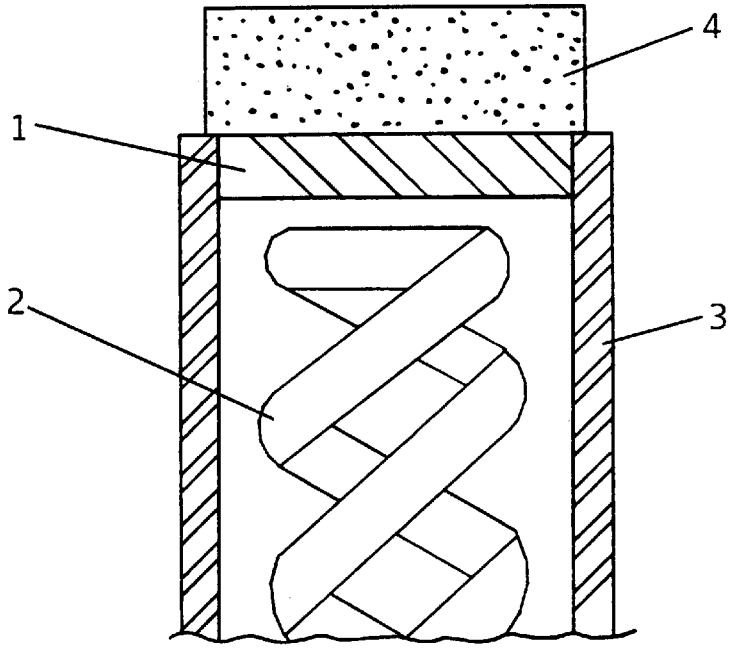
FIG. 1 is a simplified sectional view illustrating a conventional cathode for use in an electron gun.
Figure 2:
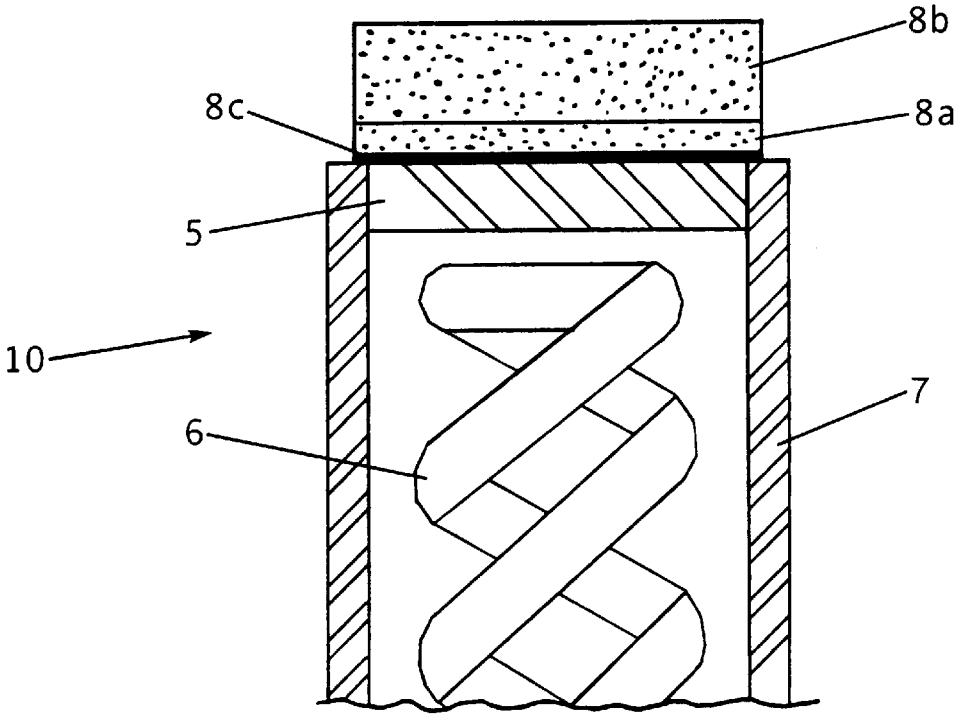
FIG. 2 is a simplified sectional view illustrating a two-layer cathode according to an embodiment of the present invention.

FIG. 2 is a sectional view of a two-layer cathode 10 in accordance with the present invention for use in an electron gun. The cathode 10 comprises a base metal 5 which is welding on one end of an open tube 7 and a two-layer electron emissive layer which is sprayed on the base metal. An inner porous electron emissive layer 8*a* having a thickness of 2–90 $\mu$m is comprised of alkaline earth metal oxide and 1–30 wt. % W and may further include 0.1–5 wt. % of a rare earth metal oxide. An outer porous electron emissive layer 8*b* is comprised of alkaline earth metal oxide which may further include 0.1–5 wt. % of a rare earth metal oxide. The total thickness of the two electron emissive layers is in the range of 35–100 $\mu$m. The principal component of the base metal is Ni with a small amount of a reducing agent such as magnesium and silicon. The alkaline earth metal oxide in a preferred embodiment contains barium oxide and may further include strontium oxide and possibly calcium oxide. The cathode also contains a heating device 6.

Oxide cathode forms a high resistance intermediate layer 8*c* of $Ba_2SiO_4$ between base metal 5 and the inner electron emissive layer 8*a* in the cathode 10 hindering the reducing agent from diffusing outwardly from the base metal resulting in reduced emission current after extended operation. In order to prevent hindering of the reducing reactions (2) and (3), 1–30 wt. % W is added to the electron emissive layer in the manufacturing process. Heating the cathode to a temperature on the order of 1000° C. during the period of activation causes the inner emission layer 8*a* around the base metal 5 to produce the $Ni_4W$ fine crystal structure. The intermediate layer $Ba_2SiO_4$ disperses into the $Ni_4W$ fine crystal layer which increases the diffusion path between the alkaline earth metal oxide and the reducing agent. Reactions (2) and (3) occur continuously to produce free barium which provides the high current density capability. In addition, W acts as a reducing agent to react with the electron emissive material for producing free barium, which further increases emission current density. This process can be expressed as follows:

$$2Ba0+1/3W \rightarrow Ba+1/3Ba_3W0_6 \quad (6)$$

The addition of a 0.1–5 wt. % rare earth metal oxide such as scandium oxide in the inner electron emissive layer 8*a* also increases emission current density. This is because $ScNi_5$ reacts with the intermediate layer resulting in the decomposition of the intermediate layer. Therefore, a substantial amount of free barium can be produced as shown by reactions (2) and (3).

In the present invention, a much larger amount of W (metal) powder is added to the suspension materials than in prior art approaches. The W powder plays an important role in the present invention and performs three functions. First, it reacts with the base metal to form a $Ni_4W$ fine crystal structure. The intermediate layer (such as $Ba_2SiO_4$) can be dispersed in this fine crystal structure resulting in an increase in the reaction path between the reducing agent and (Ba, Sr, Ca)O to increase the electron donor. Secondly, the intermediate layer is not a continuous layer, so it does not hinder the electron donor from forming. The operating life of the cathode is thus extended. Thirdly, W serves as a reducing agent to react with (Ba, Sr, Ca)O to form an electron donor which also increases the cathode current density.

The suspension used to spray on the cathode is the same as in the case of a conventional oxide cathode with the exception of the addition of 1–30 wt. % W and possibly 0.1–5 wt. % rare earth metal oxide. The W powder is preferably heat treated in hydrogen atmosphere to remove impurities before mixing with other suspension materials. The thermal expansion coefficient of the inner layer 8*a* is almost the same as that of the outer layer 8*b* so the adhesion between the base metal 5 and the inner emitter layer 8*a* or between the inner emitter layer 8*a* and the outer emitter layer 8*b* is stronger than that in the prior art. Therefore, the peeling of these layers is avoided. Moreover, the good adhesion between the emission layers remains stable during extended life testing. Compared with the prior art, the manufacturing process involved with the two-layer cathode of the present invention does not require new equipment such as sputter or vacuum evaporation apparatus to form a W film on the base metal 5. As a result, most of the manufacturing process and equipment involved in the production of conventional cathodes can be used to manufacture the two-layer cathode of the present invention.

Figure 3:
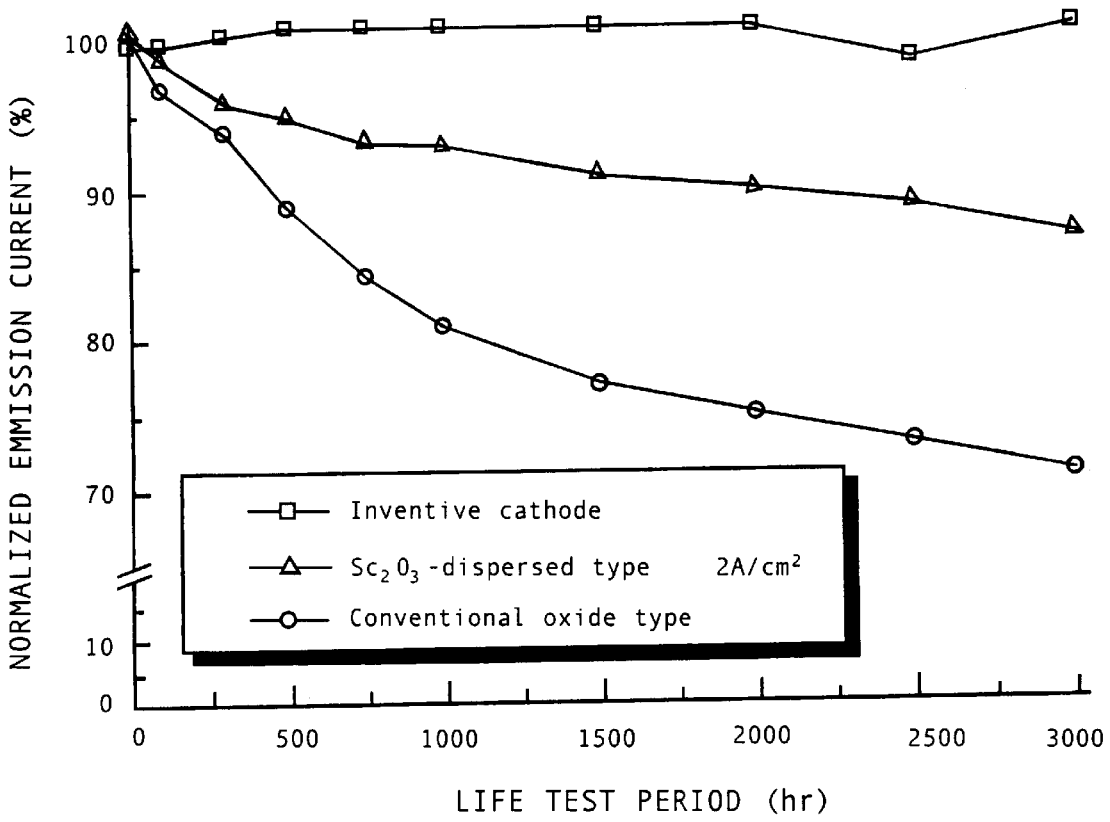
FIG. 3 is a graphic representation illustrating the relationship between life testing period and normalized emission current at a current density of about 2.0 A/cm$^2$ for a cathode in accordance with the present invention, a $Sc_2O_3$-dispersed type cathode, and a conventional oxide type cathode.

FIG. 3 is a graphic representation illustrating the relationship between the life test period and normalized emission current at a current density of approximately 2.0 A/cm$^2$ for a cathode in accordance with the present invention. In FIG. 3, the line formed of squares represents the life testing performance of a cathode in accordance with the present invention having an inner emission layer comprised of alkaline earth metal oxide and 20 wt. % W and an outer emission layer comprised of alkaline earth metal oxide and 1.5 wt. % scandium oxide ($Sc_2O_3$). The line formed of triangles represents the life testing performance of a prior art Mitsubishi $Sc_2O_3$-dispersed-oxide-cathode, while the line formed of circles represents the life testing performance of a conventional oxide cathode. From FIG. 3, it can be seen that the normalized emission current of the conventional cathode decreases 30%, and that of the $Sc_2O_3$-dispersed-oxide cathode reduces 14% under the same conditions. The normalized emission current of the cathode of the present invention increases up until the test period to approximately 500 hours and then saturates after 500 hours which shows that the two-layer cathode of the present invention increases the operating lifetime of the cathode.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

We claim:

1. A cathode for use in an electron gun, said cathode comprising:

a tubular sleeve;

a heater disposed in said tubular sleeve;

a base metal disposed on one end of said tubular sleeve in close proximity to said heater, wherein said base metal is comprised primarily of Ni and further includes a reducing agent; and a two-layer porous electron emissive substrate disposed on said base metal, said two-layer porous electron emissive substrate comprised of an inner layer of alkaline earth metal oxide and 1–30 wt. % W and an outer layer of alkaline earth metal oxide, wherein said W is in the form of a powder and wherein said W powder is thermally treated in a hydrogen atmosphere before mixing with said alkaline earth metal oxide and wherein said porous electron emissive substrate is in the form of a fluid for spray application of said porous electron emissive substrate on said base metal.

2. A cathode according to claim 1 wherein said alkaline earth metal oxide includes barium oxide.

3. A cathode according to claim 1 wherein said alkaline earth metal oxide further includes strontium oxide and calcium oxide.

4. A cathode according to claim 1 wherein said inner layer further includes 0.1–5 wt. % rare earth metal oxide.

5. A cathode according to claim 1 wherein said outer layer further includes 0.1–5 wt. % rare earth metal oxide.

6. A cathode according to claim 4 or 5 wherein said rare earth metal oxide comprises $Sc_2O_3$.

7. A cathode according to claim 1 wherein said reducing agent is comprised primarily of Mg and Si.

8. A cathode according to claim 1 wherein said inner layer has a thickness in the range of 2–90 $\mu$m.

9. A cathode according to claim 8 wherein said two-layer porous electron emissive substrate has a thickness in the range of 35–100 $\mu$m.

10. A cathode for use in an electron gun, said cathode comprising:

a tubular sleeve;

a heater disposed in said tubular sleeve;

a base metal disposed on one end of said tubular sleeve in close proximity to said heater, wherein said base metal is comprised primarily of Ni and further includes a reducing agent comprised primarily of Mg and Si; and a two-layer porous electron emissive substrate disposed on said base metal, said two-layer porous electron emissive substrate being in the form of a fluid for spray application of said porous electron emissive substrate on said base metal and including an inner layer disposed on said base metal and an outer layer disposed on said inner layer, wherein said inner layer is comprised of alkaline earth metal oxide, 1–30 wt. % W, and 0.1–5 wt. % rare earth metal oxide, and wherein said outer layer is comprised of an alkaline earth metal oxide and 0.1–5 wt. % rare earth metal oxide, and wherein said alkaline earth metal oxide includes barium oxide and said rare earth metal oxide includes scandium oxide.

* * * * *